US008469045B2

(12) United States Patent
Zhou

(10) Patent No.: US 8,469,045 B2
(45) Date of Patent: Jun. 25, 2013

(54) COLLAPSIBLE TENT FRAME

(76) Inventor: Nanqing Zhou, Fujian (CN)

( * ) Notice: Subject to any disclaimer, the term of this patent is extended or adjusted under 35 U.S.C. 154(b) by 0 days.

(21) Appl. No.: 12/489,700

(22) Filed: Jun. 23, 2009

(65) Prior Publication Data

US 2010/0319743 A1 Dec. 23, 2010

(51) Int. Cl.
*E04H 15/36* (2006.01)

(52) U.S. Cl.
USPC ..... 135/135

(58) Field of Classification Search
USPC ..... 135/25.33, 28, 98, 135, 147
See application file for complete search history.

(56) References Cited

U.S. PATENT DOCUMENTS 1,031,868 A * 7/1912 Peterson ..... 135/25.33
1,034,846 A * 8/1912 Thomas ..... 135/25.33
1,045,976 A * 12/1912 Hildreth ..... 135/25.3
1,513,655 A * 10/1924 Turner ..... 135/25.33
4,256,129 A * 3/1981 Gilsenan ..... 135/98
5,329,953 A * 7/1994 Becher ..... 135/31
7,293,573 B2 * 11/2007 Clarke ..... 135/20.3
7,607,447 B1 * 10/2009 Han ..... 135/135

* cited by examiner

*Primary Examiner* — Noah Chandler Hawk

(57) ABSTRACT

A collapsible tent frame includes an upper connecting holder, a guiding rod, a plurality of poles, a plurality of first support rods, a middle connecting holder, a plurality of second support rods, and a lower connecting holder. Each of the plurality of first support rods has an inner end articulated to the middle connecting holder and an outer end articulated to an inner end of one of the plurality of poles. The first support rods provide an outward support action between the middle connecting holder and the poles to ensure that the tent won't be collapsed automatically after the tent is expanded, without the need for the fasteners of a traditional tent frame. The present invention is simple in structure and operation, and provides a better rigidity because there are four second support rods.

4 Claims, 5 Drawing Sheets

COLLAPSIBLE TENT FRAME

BACKGROUND OF THE INVENTION

1. Field of the Invention

The present invention relates to a tent structure, and more particularly to a collapsible tent frame.

2. Description of the Prior Art

To assemble a conventional tent needs two or more people to collaborate and finish the assembly, which is inconvenient for operation. Accordingly, it is necessary to improve its structure. As shown in FIG. 1, Chinese Patent No. 23238607.9 disclosed a collapsible tent frame, which comprises four upper rods 1', two middle rods 2', two lower rods 3', a connecting rod 4', a middle connecting holder 5', a lower connecting holder 6', a rotating buckle 7', and a plurality of sleeves 8'. The four upper rods 1' are symmetrically connected to the connecting rod 4'. The two middle rods 2' are symmetrically connected to the middle connecting holder 5'. The two lower rods 3' are symmetrically connected to the lower connecting holder 6'. The middle connecting holder 5' and the lower connecting holder 6' are coordinated with the connecting rod 4'. The rotating buckle 7' is disposed on the lower holder 6'. The sleeves 8' are disposed on the joints of the upper rods 1'. The two middle rods 2' of this conventional tent frame are articulated to the middle portions of the upper rods 1'. After expanding the tent, the rotating buckle 7' is adapted to fix the tent frame, which adds the working procedure in use.

SUMMARY OF THE INVENTION

The primary object of the present invention is to provide a collapsible tent frame which is simple in structure and operation, and provides a better rigidity.

According to the present invention, there is provided a collapsible tent frame, comprising an upper connecting holder, a guiding rod, a plurality of poles, a plurality of first support rods, a middle connecting holder, a plurality of second support rods, and a lower connecting holder; each of the plurality of poles having an inner end articulated to the upper connecting holder, the guiding rod having an upper end fixed to a lower end surface of the upper connecting holder and a lower portion extending downwards; each of the plurality of first support rods having an inner end articulated to the middle connecting holder and an outer end articulated to the inner end of one of the plurality of poles, the middle connecting holder having a middle guiding hole for insertion of the guiding rod so that the middle connecting holder is able to move upwards and downwards along the guiding rod; each of the plurality of second support rods having an inner end articulated to the lower connecting holder and an outer end articulated to a middle portion of one of the plurality of poles, the lower connecting holder having a middle guiding hole for insertion of the guiding rod so that the lower connecting holder is able to move upwards and downwards along the guiding rod.

Preferably, the collapsible tent frame further comprises inner hinge joints, each of the inner hinge joints being in the form of English letter L and having an inner end articulated to the upper connecting holder, an outer end connected with the inner end of one of the plurality of poles, and a transverse projection, the outer end of each of the plurality of first support rods being articulated to the transverse projection.

Preferably, the collapsible tent frame further comprises middle hinge joints, each of the middle hinge joints being fitted on the middle portion of each of the plurality of poles and having a transverse projection, the outer end of each of the plurality of second support rods being articulated to the transverse projection.

Preferably, the number of the plurality of poles is four, the number of the plurality of first support rods is two, and the number of the plurality of second support rods is four.

Thereby, each of the plurality of first support rods has its inner end articulated to the middle connecting holder and its outer end articulated to the inner end of one of the plurality of poles. The first support rods provide an outward support action between the middle connecting holder and the poles to ensure that the tent won't be collapsed automatically after the tent is expanded, without the need for the fasteners of a traditional tent frame. The present invention is simple in structure and operation, and provides a better rigidity because there are four second support rods. In addition, the present invention improves the tent frame for a person to expand and collapse the tent, which is very convenient in use.

DETAILED DESCRIPTION OF THE PREFERRED EMBODIMENTS

Embodiments of the present invention will now be described, by way of example only, with reference to the accompanying drawings.

Figure 1:
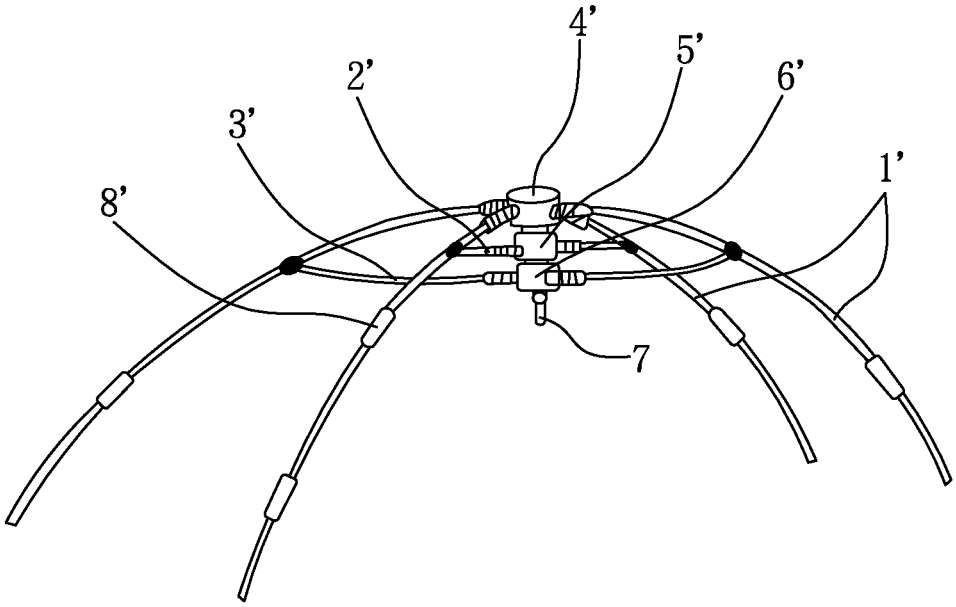
FIG. 1 PRIOR ART
FIG. 1 is a perspective view of a conventional collapsible tent frame.
Figure 2:
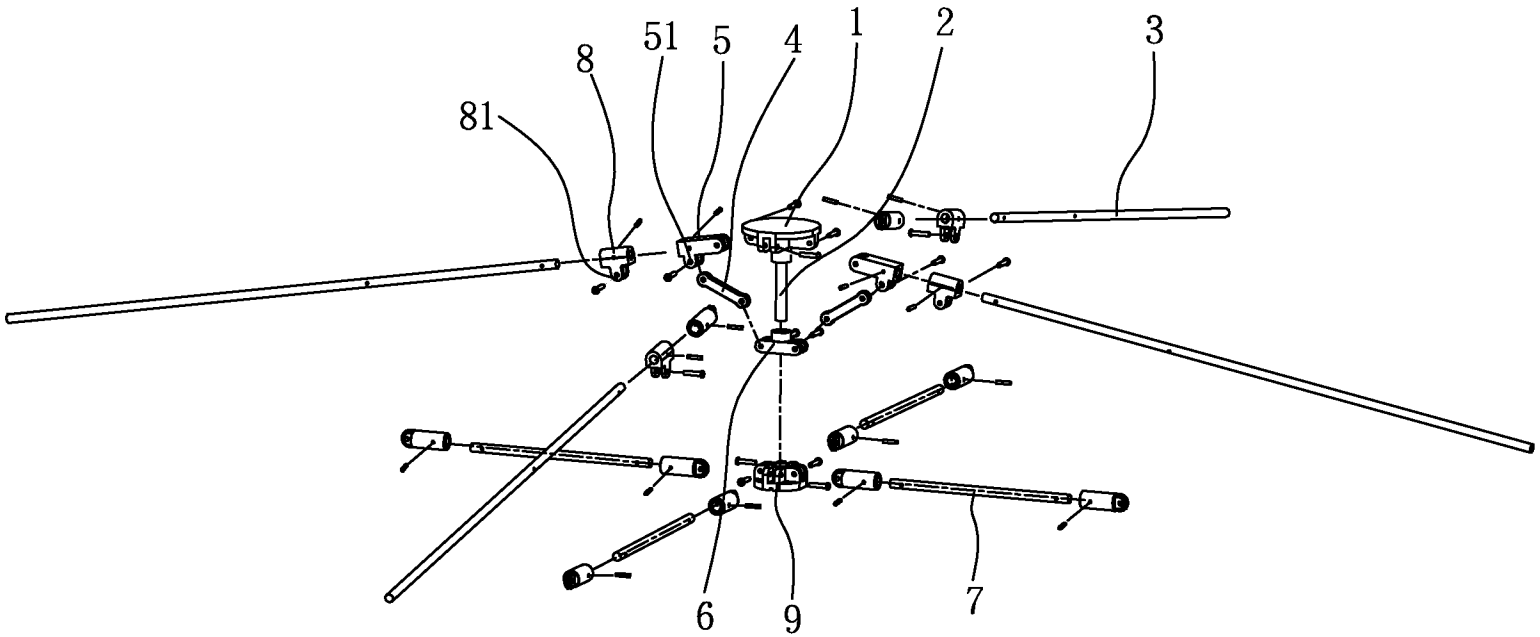
FIG. 2 is an exploded view of a preferred embodiment of the present invention.

As shown in FIG. 2, a collapsible tent frame according to a preferred embodiment of the present invention comprises an upper connecting holder 1, a guiding rod 2, four poles 3, two first support rods 4, inner hinge joints 5, a middle connecting holder 6, four second support rods 7, middle hinge joints 8, and a lower connecting holder 9.

Each of the four poles 3 has an inner end articulated to the upper connecting holder 1. The guiding rod 2 has an upper end fixed to a lower end surface of the upper connecting holder 1 and a lower portion extending downwards.

Figure 3:
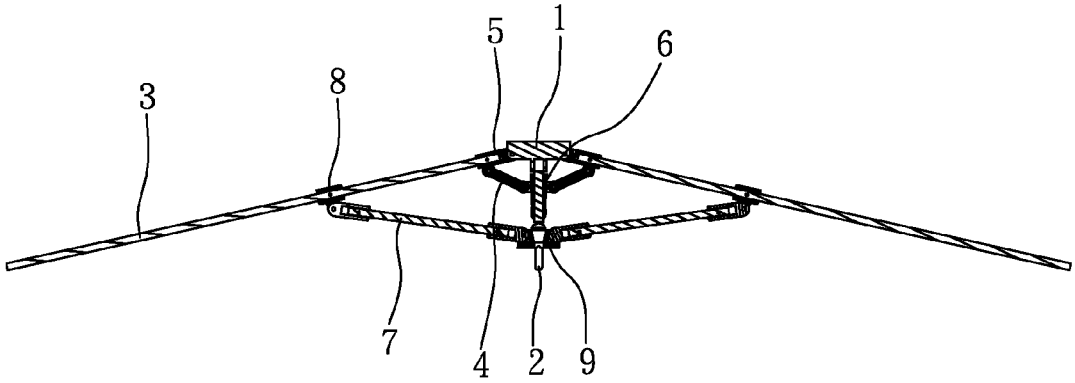
FIG. 3 is a cross-sectional view of the preferred embodiment of the present invention.
Figure 3A:
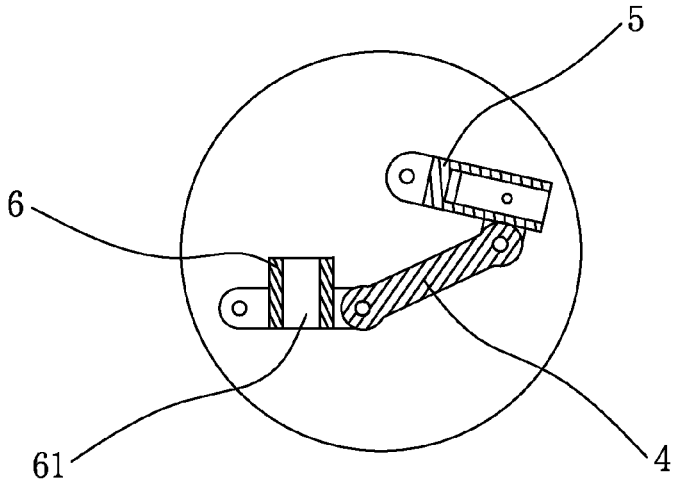
FIG. 3*a* is a cross-sectional view of a middle connecting holder of the preferred embodiment of the present invention.

Each of the inner hinge joints 5 is in the form of English letter L, and has an inner end articulated to the upper connecting holder 1, an outer end connected with the inner end of one of the four poles 3, and a transverse projection 51. Each of the two first support rods 4 has an outer end articulated to the transverse projection 51 and an inner end articulated to the middle connecting holder 6. The outer ends of the two first support rods 4 are articulated to the inner ends of two symmetric poles 3 of the four poles 3. The middle connecting holder 6 has a middle guiding hole 61, as shown in FIG. 3*a*, for insertion of the guiding rod 2 so that the middle connecting holder 6 is able to move upwards and downwards along the guiding rod 2. When the middle connecting holder 6 is moved upwards and downwards along the guiding rod 2, the first support rods 4 will be linked to collapse or to expand the poles 3.

Figure 3B:
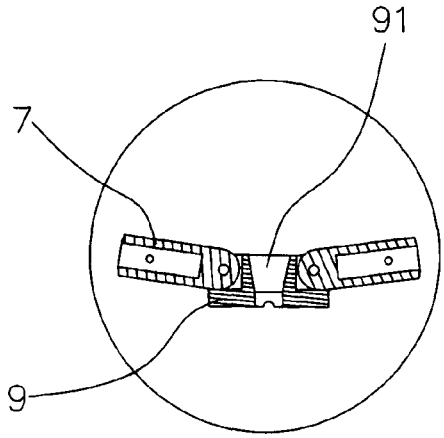
FIG. 3*b* is a cross-sectional view of a lower connecting holder of the preferred embodiment of the present invention.

Each of the middle hinge joints 8 is fitted on a middle portion of one of the poles 3, and has a transverse projection 81. Each of the four second support rods 7 has an outer end articulated to the transverse projection 81 so that the four second support rods 7 have their outer ends articulated to the middle portions of the four poles 3. Each of the four second support rods 7 has an inner end articulated to the lower connecting holder 9. The lower connecting holder 9 has a middle guiding hole 91, as shown in FIG. 3*b*, for insertion of the guiding rod 2 so that the lower connecting holder 9 is able to move upwards and downwards along the guiding rod 2.

Figure 4A:
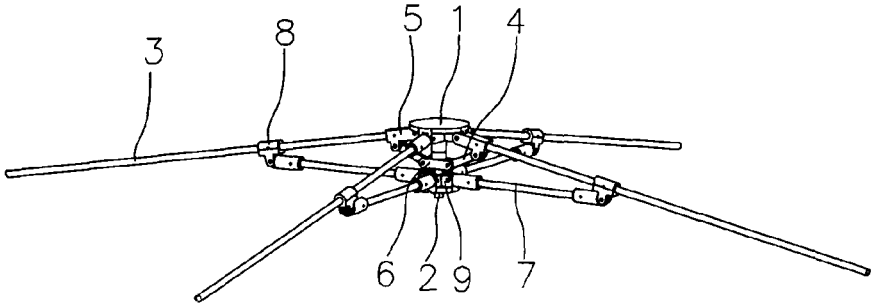
FIG. 4*a* is a schematic view of the preferred embodiment of the present invention in a fully expanded state.

As shown in FIG. 4*a*, the middle connecting holder 6 and the lower connecting holder 9 are moveably fitted on the guiding rod 2. When the middle connecting holder 6 and the lower connecting holder 9 are moved upwards along the guiding rod 2 to abut against the upper connecting holder 1, the tent is in a fully expanded state.

Figure 4B:
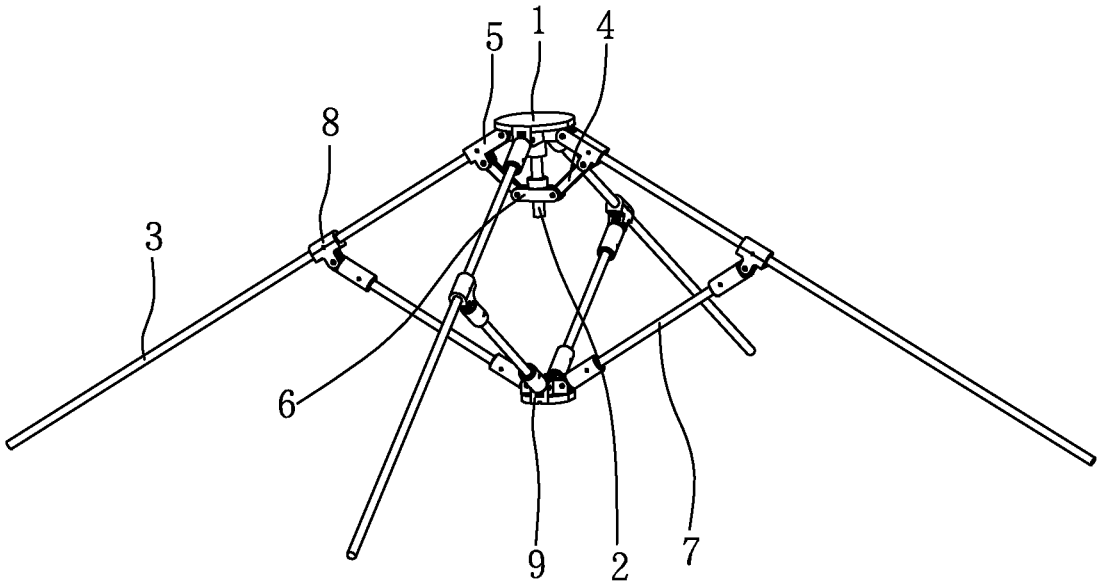
FIG. 4*b* is a schematic view of the preferred embodiment of the present invention in a partly expanded state.

As shown in FIG. 4*b*, the middle connecting holder 6 is moved downwards along the guiding rod 2 and the lower connecting holder 9 disengages from the guiding rod 2 to collapse the tent gradually.

Figure 4C:
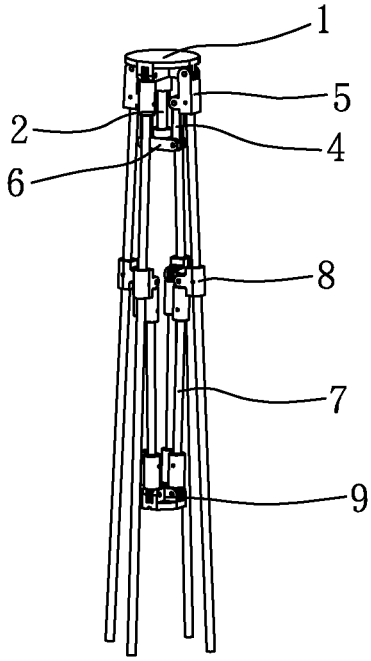
FIG. 4*c* is a schematic view of the preferred embodiment of the present invention in a collapsed state.

As shown in FIG. 4*c*, the middle connecting holder 6 is further moved downwards along the guiding rod 2 and the lower connecting holder 9 is distant from the upper connecting holder 1 so that the tent frame is fully collapsed.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A collapsible tent frame, comprising an upper connecting holder, a guiding rod, a plurality of poles, a plurality of first support rods, inner hinge joints, each of the inner hinge joints articulated separately to the upper connecting holder, to one of the plurality of poles, and to one of the plurality of first support rods, a middle connecting holder cylindrically configured in a center thereof for surrounding throughout a middle guiding hole (61) therewithin for insertion of the guiding rod, a plurality of second support rods, and a lower connecting holder annularly shaped in a middle thereof for forming a middle guiding hole (91) surrounded throughout by the lower connecting holder, with the middle guiding hole (91) open throughout when the tent is folded, and receiving the guiding rod when the tent is unfolded, each of the plurality of poles having an inner end connected to an inner hinge joint and thereby articulated to the upper connecting holder, the guiding rod having an upper end fixed to a lower end surface of the upper connecting holder and a lower portion extending downwards;

each of the plurality of first support rods having an inner end articulated to the middle connecting holder and an outer end connected to an inner hinge joint and thereby articulated to the inner end of one of the plurality of poles, each of the plurality of second support rods having an inner end articulated to the lower connecting holder and an outer end articulated to a middle portion of one of the plurality of poles.

2. The collapsible tent frame as claimed in claim 1, each of the inner hinge joints being in the form of English letter L and having an inner end articulated to the upper connecting holder, an outer end connected with the inner end of one of the plurality of poles, and a transverse projection, the outer end of each of the plurality of first support rods being articulated to the transverse projection.

3. The collapsible tent frame as claimed in claim 1, further comprising middle hinge joints, each of the middle hinge joints being fitted on the middle portion of each of the plurality of poles and having a transverse projection, the outer end of each of the plurality of second support rods being articulated to the transverse projection.

4. The collapsible tent frame as claimed in claim 1, wherein the number of the plurality of poles is four, the number of the plurality of first support rods is two, and the number of the plurality of second support rods is four.

* * * * *